US009694367B2

(12) United States Patent
Moran et al.

(10) Patent No.: US 9,694,367 B2
(45) Date of Patent: Jul. 4, 2017

(54) METHOD FOR PRODUCING A ZIRCONIUM CONCENTRATED PRODUCT FROM FROTH TREATMENT TAILINGS

(71) Applicant: Titanium Corporation Inc., Edmonton (CA)

(72) Inventors: Kevin Moran, Edmonton (CA); Jacques Doiron, Devon (CA)

(73) Assignee: TITANIUM CORPORATION, INC. (CA)

( * ) Notice: Subject to any disclaimer, the term of this patent is extended or adjusted under 35 U.S.C. 154(b) by 0 days.

(21) Appl. No.: 15/026,503

(22) PCT Filed: Oct. 10, 2013

(86) PCT No.: PCT/CA2013/000862

§ 371 (c)(1),
(2) Date: Mar. 31, 2016

(87) PCT Pub. No.: WO2015/051435

PCT Pub. Date: Apr. 16, 2015

(65) Prior Publication Data

US 2016/0243558 A1 Aug. 25, 2016

(51) Int. Cl.
*B03B 7/00* (2006.01)
*B03B 9/02* (2006.01)
(Continued)

(52) U.S. Cl.
CPC ..... *B03B 9/02* (2013.01); *B03B 7/00* (2013.01); *B03C 1/30* (2013.01); *B03C 7/06* (2013.01); *B03D 1/08* (2013.01); *C10G 1/045* (2013.01); *C10G 1/047* (2013.01); *C22B 34/14* (2013.01); *C10G 2300/1033* (2013.01)

(58) Field of Classification Search
CPC .... B03B 9/02; B03B 7/00; B03C 1/30; B03C 7/06; C10G 1/045; C10G 1/047
USPC ..... 209/12.1, 12.2, 10, 165; 208/311, 390, 208/409, 424, 427
See application file for complete search history.

(56) References Cited

U.S. PATENT DOCUMENTS 3,337,328 A * 8/1967 Lawver ..... B03B 9/00 209/166
3,656,938 A * 4/1972 Penzes ..... C22B 34/14 209/165

(Continued)

FOREIGN PATENT DOCUMENTS

CA 861580 1/1971
CA 879996 8/1971

(Continued)

*Primary Examiner* — Terrell Matthews
(74) *Attorney, Agent, or Firm* — Terrence N. Kuharchuk; Rodman & Rodman

(57) ABSTRACT

A method for processing a heavy mineral concentrate obtained from froth treatment tailings to produce a zirconium concentrated product, including subjecting the heavy mineral concentrate to froth flotation, subjecting a flotation product to initial gravity separation, subjecting an initial gravity separation product to primary dry separation, subjecting a primary dry separation product to finishing gravity separation, and subjecting a finishing gravity separation product to finishing dry separation to produce a finishing dry separation product as the zirconium concentrated product.

34 Claims, 11 Drawing Sheets

(51) Int. Cl.

| | |
|---|---|
| ***B03D 1/08*** | (2006.01) |
| ***C22B 34/14*** | (2006.01) |
| ***C10G 1/04*** | (2006.01) |
| ***B03C 1/30*** | (2006.01) |
| ***B03C 7/06*** | (2006.01) |

(56) References Cited

U.S. PATENT DOCUMENTS

| | | | | |
|---|---|---|---|---|
| 3,990,885 | A | 11/1976 | Baillie et al. | |
| 4,138,467 | A | 2/1979 | Kaminsky et al. | |
| 4,150,093 | A | 4/1979 | Kaminsky et al. | |
| 4,225,422 | A * | 9/1980 | Trevoy | B07B 1/00 208/427 |
| 5,106,489 | A | 4/1992 | Schmidt et al. | |
| 7,341,658 | B2 | 3/2008 | Reeves | |
| 7,695,612 | B2 * | 4/2010 | Erasmus | B03D 1/02 208/390 |
| 8,382,976 | B2 | 2/2013 | Moran et al. | |
| 8,852,429 | B2 | 10/2014 | Moran et al. | |
| 2011/0061610 | A1 * | 3/2011 | Speirs | C10G 1/045 122/32 |
| 2011/0233115 | A1 | 9/2011 | Moran et al. | |
| 2011/0278202 | A1 | 11/2011 | Moran et al. | |

FOREIGN PATENT DOCUMENTS

| | | |
|---|---|---|
| CA | 927983 | 6/1973 |
| CA | 1013696 | 7/1977 |
| CA | 1076504 | 4/1980 |
| CA | 1088883 | 11/1980 |
| CA | 2084261 | 6/1993 |
| CA | 1326571 | 1/1994 |
| CA | 2426113 | 10/2003 |
| CA | 2548006 | 11/2007 |
| CA | 2674660 | 11/2009 |
| CA | 2638120 | 1/2010 |
| CA | 2662346 | 10/2010 |
| CA | 2693879 | 8/2011 |
| CA | 2712725 | 11/2011 |

* cited by examiner

HEAVY MINERAL CONCENTRATE (HMC)
FEED MATERIAL

| Sample Number | Bitumen Content | Total Heavy Minerals Content | $ZrO_2$ Content | $TiO_2$ Content |
|---|---|---|---|---|
| | (wt%) | (wt%) | (wt%) | (wt%) |
| FF3531 | 0.54 | 65.36 | 4.73 | 17.4 |
| FF3925 | 0.49 | 62.37 | 5.01 | 18.3 |
| FF3501 | 0.46 | 62.59 | 4.79 | 16.4 |
| FF3502 | 0.49 | 65.33 | 5.14 | 16.9 |
| FF3503 | 0.55 | 61.82 | 4.64 | 16.1 |
| FF3504 | 0.58 | 64.32 | 4.87 | 16.6 |
| FF3505 | 0.50 | 61.90 | 5.24 | 16.7 |
| FF6282 | 0.54 | 58.77 | 4.8 | 15.9 |
| FF6283 | 0.44 | 64.39 | 5.63 | 16.6 |
| FF6284 | 0.56 | 57.03 | 4.69 | 15.5 |
| FF6285 | 0.61 | 56.76 | 5.58 | 15.9 |
| FF6286 | 0.50 | 58.27 | 4.69 | 14.8 |
| FF6291 | 0.56 | 57.70 | 4.22 | 14.3 |
| FF6292 | 0.57 | 59.72 | 4.46 | 14.1 |

FIG. 8

FROTH FLOTATION
(OPERATING CONDITIONS)

| ROUGHER STAGE | | | |
|---|---|---|---|
| REAGENTS | | Conditioning Time (min) | Float Time (min) |
| Acid | Sulphuric Acid | 3 | |
| Starch | Unmodified Wheat Starch | 5 | |
| Sodium Fluorosilicate | $Na_2SiF_6$ | 3 | |
| Frother | C-007 | 1 | |
| Rougher Cell 1 | Flotigam 2835 2% solution | 3 | 3 |
| Rougher Cell 2 | Flotigam 2835 2% solution | 3 | 3 |
| Rougher Cell 3 | Flotigam 2835 2% solution | 3 | 3 |
| Rougher Cell 4 | Flotigam EDA 2% solution | 3 | 3 |
| Rougher Cell 5 | Flotigam EDA 2% solution | 3 | 3 |
| | | | |
| SCAVENGER STAGE | | | |
| REAGENTS | | Conditioning Time (min) | Float Time (min) |
| Acid | Sulphuric Acid | 3 | |
| Starch | Unmodified Wheat Starch | 5 | |
| SodiumFluorosilicate | $Na_2SiF6$ | 3 | |
| Frother | C-007 | 1 | |
| Scavenger Cell 1 | Flotigam 2835 2% solution | 3 | 3 |
| Scavenger Cell 2 | Flotigam 2835 2% solution | 3 | 3 |
| Scavenger Cell 3 | Flotigam EDA 2% solution | 3 | 3 |
| Scavenger Cell 4 | Flotigam EDA 2% solution | 3 | 3 |

FIG. 9

OVERALL MATERIAL BALANCE

| | FEED | FROTH FLOTATION | | INITIAL GRAVITY SEPARATION | | PRIMARY ELECTROSTATIC/ MAGNETIC SEPARATION | |
|---|---|---|---|---|---|---|---|
| STREAM | HMC | Product | Tailings | Product | Tailings | Product | Tailings |
| MASS (kg) | 100 | 44.34 | 55.66 | 27.30 | 17.04 | 9.62 | 17.41 |
| $ZrO_2$ (%) | 5.4 | 5.06 | 0.34 | 4.91 | 0.15 | 4.43 | 0.48 |
| $TiO_2$ (%) | 17.8 | 9.03 | 8.77 | 5.65 | 3.38 | 0.33 | 5.32 |
| $Al_2O_3$ (%) | 5.86 | 4.34 | 1.52 | 2.25 | 2.08 | 0.68 | 1.57 |
| $Fe_2O_3$ (%) | 15.51 | 8.03 | 7.48 | 6.14 | 1.89 | 0.147 | 5.99 |
| $SiO_2$ (%) | 35.94 | 10.41 | 25.53 | 5.69 | 4.72 | 3.47 | 2.21 |
| S (%) | 7.12 | 3.23 | 3.89 | 2.85 | 0.38 | 0.022 | 0.36 |
| Other (%) | 12.37 | 4.24 | 8.13 | -0.19 | 4.44 | 0.541 | 1.48 |

FIG. 12

OVERALL MATERIAL BALANCE (CONTINUED)

| | FINISHING GRAVITY SEPARATION | | FINISHING ELECTROSTATIC/ MAGNETIC SEPARATION | | ZIRCONIUM CONCENTRATED PRODUCT | |
|---|---|---|---|---|---|---|
| STREAM | Product | Tailings | Product | Tailings | Calculated | Measured |
| MASS (kg) | 7.72 | 1.90 | 5.71 | 2.01 | 5.71 | 5.76 |
| $ZrO_2$ (%) | 4.25 | 0.18 | 3.85 | 0.40 | 67.07 | 66.01 |
| $TiO_2$ (%) | 0.16 | 0.17 | 0.013 | 0.147 | 0.226 | 0.28 |
| $Al_2O_3$ (%) | 0.45 | 0.23 | 0.01 | 0.22 | 0.174 | 0.12 |
| $Fe_2O_3$ (%) | 0.078 | 0.069 | 0.006 | 0.072 | 0.105 | 0.09 |
| $SiO_2$ (%) | 2.61 | 0.86 | 1.87 | 0.74 | 32.58 | 32.56 |
| S (%) | 0.014 | 0.008 | 0.004 | 0.01 | 0.070 | 0.060 |
| Other (%) | 0.158 | 0.383 | -0.013 | 0.391 | -0.226 | NIL |

FIG. 12 (Continued)

ZIRCONIUM RECOVERIES

| SEPARATION OPERATION | $ZrO_2$ RECOVERY | CUMULATIVE $ZrO_2$ RECOVERY |
|---|---|---|
| Froth Flotation | 93.7 | 93.7 |
| Initial Gravity Separation | 97.0 | 90.9 |
| Primary Electrostatic/Magnetic Separation | 90.3 | 82.1 |
| Finishing Gravity Separation | 96.0 | 78.8 |
| Finishing Electrostatic/Magnetic Separation | 90.6 | 71.4 |

FIG. 13

METHOD FOR PRODUCING A ZIRCONIUM CONCENTRATED PRODUCT FROM FROTH TREATMENT TAILINGS

TECHNICAL FIELD

A method for producing a zirconium concentrated product from froth treatment tailings.

BACKGROUND OF THE INVENTION

Oil sand is essentially comprised of a matrix of bitumen, solid mineral material and water.

The bitumen component of oil sand includes hydrocarbons which are typically quite viscous at normal in situ temperatures and which act as a binder for the other components of the oil sand. For example, bitumen has been defined by the United Nations Institute for Training and Research as a hydrocarbon with a viscosity greater than $10^4$ mPa s (at deposit temperature) and a density greater than 1000 kg/m$^3$ at 15.6 degrees Celsius.

The solid mineral material component of oil sand typically consists of sand, rock, silt and clay. Solid mineral material may be present in oil sand as coarse mineral material or fine mineral material. The accepted division between coarse mineral material and fine mineral material is typically a particle size of about 44 microns. Solid mineral material having a particle size greater than about 44 microns is typically considered to be coarse mineral material, while solid mineral material having a particle size less than about 44 microns is typically considered to be fine mineral material. Sand and rock are generally present in oil sand as coarse mineral material, while silt and clay are generally present in oil sand as fine mineral material.

A typical deposit of oil sand may contain (by weight) about 10 percent bitumen, up to about 6 percent water, with the remainder being comprised of solid mineral material, which may include a relatively small amount of impurities such as humic matter and heavy minerals.

Water based technologies are typically used to extract bitumen from oil sand ore originating from the Athabasca area in northeastern Alberta, Canada. A variety of water based technologies exist, including the Clark "hot water" process and a variety of other processes which may use hot water, warm water or cold water in association with a variety of different separation apparatus.

In a typical water based oil sand extraction process, the oil sand ore is first mixed with water to form an aqueous slurry. The slurry is then processed to release bitumen from within the oil sand matrix and prepare the bitumen for separation from the slurry, thereby providing a conditioned slurry. The conditioned slurry is then processed in one or more separation apparatus which promote the formation of a primary bitumen froth while rejecting coarse mineral material and much of the fine mineral material and water. The separation apparatus may also produce a middlings stream from which a secondary bitumen froth may be scavenged. This secondary bitumen froth may be added to the primary bitumen froth or may be kept separate from the primary bitumen froth.

A typical bitumen froth (comprising a primary bitumen froth and/or a secondary bitumen froth) may contain (by weight) about 60 percent bitumen, about 30 percent water and about 10 percent solid mineral material, wherein a large proportion of the solid mineral material is fine mineral material. The bitumen which is present in a typical bitumen froth is typically comprised of both non-asphaltenic material and asphaltenes.

This bitumen froth is typically subjected to a froth treatment process in order to reduce its solid mineral material and water concentration by separating the bitumen froth into a bitumen product and froth treatment tailings.

In a typical froth treatment process, the bitumen froth is diluted with a froth treatment diluent to provide a density gradient between the hydrocarbon phase and the water phase and to lower the viscosity of the hydrocarbon phase. The diluted bitumen froth is then subjected to separation in one or more separation apparatus in order to produce the bitumen product and the froth treatment tailings. Exemplary separation apparatus include gravity settling vessels, inclined plate separators and centrifuges.

Some commercial froth treatment processes use naphthenic type diluents (defined as froth treatment diluents which consist essentially of or contain a significant amount of one or more aromatic compounds). Examples of naphthenic type diluents include toluene (a light aromatic compound) and naphtha, which may be comprised of both aromatic and non-aromatic compounds.

Other commercial froth treatment processes use paraffinic type diluents (defined as froth treatment diluents which consist essentially of or contain significant amounts of one or more relatively short-chained aliphatic compounds). Examples of paraffinic type diluents are C4 to C8 aliphatic compounds and natural gas condensate, which typically contains short-chained aliphatic compounds and may also contain small amounts of aromatic compounds.

Froth treatment processes which use naphthenic type diluents (i.e., naphthenic froth treatment processes) typically result in a relatively high bitumen recovery (perhaps about 98 percent), but also typically result in a bitumen product which has a relatively high solid mineral material and water concentration.

Froth treatment processes which use paraffinic type diluents (i.e., paraffinic froth treatment processes) typically result in a relatively lower bitumen recovery (in comparison with naphthenic froth treatment processes), and in a bitumen product which has a relatively lower solid mineral material and water concentration (in comparison with naphthenic froth treatment processes). Both the relatively lower bitumen recovery and the relatively lower solid mineral material and water concentration may be attributable to the phenomenon of asphaltene precipitation, which occurs in paraffinic froth treatment processes when the concentration of the paraffinic type diluent exceeds a critical level. This asphaltene precipitation results in bitumen being lost to the froth treatment tailings, but also provides a cleaning effect in which the precipitating asphaltenes trap solid mineral material and water as they precipitate, thereby separating the solid mineral material and the water from the bitumen froth.

Froth treatment tailings therefore typically contain solid mineral material, water, froth treatment diluent, and small amounts of residual bitumen (perhaps about 2-12 percent of the bitumen which was contained in the original bitumen froth, depending upon whether the froth treatment process uses a naphthenic type diluent or a paraffinic type diluent).

Much of the froth treatment diluent is typically recovered from the froth treatment tailings in a tailings solvent recovery unit (TSRU). The froth treatment tailings (including the tailings bitumen) are then typically disposed of in a tailings pond.

A significant amount of bitumen from the original oil sand ore is therefore typically lost to the froth treatment tailings as residual bitumen. There are both environmental incentives and economic incentives for recovering all or a portion of this residual bitumen.

In addition, the solid mineral material which is included in the froth treatment tailings comprises an amount of heavy minerals. Heavy minerals are typically considered to be solid mineral material which has a specific gravity greater than that of quartz (i.e., a specific gravity greater than about 2.65). The heavy minerals in the solid mineral material which is contained in typical froth treatment tailings may include titanium metal minerals such as rutile ($TiO_2$), anatase ($TiO_2$), ilmenite ($FeTiO_3$) and leucoxene (typically an alteration product of ilmenite) and zirconium metal minerals such as zirconia ($ZrO_2$) and zircon ($ZrSiO_4$). Titanium and zirconium bearing minerals are typically used as feedstocks for manufacturing engineered materials due to their inherent properties.

Although oil sand ore may contain a relatively low concentration of heavy minerals, it is known that these heavy minerals tend to concentrate in the bitumen froth which is extracted from the oil sand ore, and therefore become concentrated in the froth treatment tailings which result from froth treatment processes.

Heavy minerals are often present in froth treatment tailings as relatively fine coarse mineral material (i.e., having a particle size between about 44 microns and about 100 microns) or as fine mineral material (i.e., having a particle size smaller than about 44 microns). However, even heavy minerals which are present in froth treatment tailings as fine mineral material tend to be associated primarily with the coarse mineral material in froth treatment tailings, due in part to the relatively high specific gravity of heavy minerals.

As a result, froth treatment tailings, and especially a coarse mineral material fraction obtained from froth treatment tailings, may typically contain a sufficient concentration of heavy minerals to provide an economic incentive to recover these heavy minerals from the froth treatment tailings.

The physical and chemical characteristics of froth treatment tailings and of the heavy minerals which may be contained in froth treatment tailings present challenges to recovering heavy minerals from froth treatment tailings.

Examples in the prior art of processes directed at recovering heavy minerals from oil sand and/or from tailings derived from oil sand include the following patent documents.

Canadian Patent No. 861,580 (Bowman) describes a process for the recovery of heavy metals from a primary bitumen froth. Canadian Patent No. 879,996 (Bowman) describes a process for the recovery of heavy metals from a secondary bitumen froth. Canadian Patent No. 927,983 (Penzes) describes a process for the recovery of heavy metal materials from primary bitumen froth. Canadian Patent No. 1,013,696 (Baillie et al) describes a process for producing from froth treatment tailings a quantity of heavy metal compounds such as titanium and zirconium minerals which are substantially free of bitumen and other hydrocarbon substances. Canadian Patent No. 1,076,504 (Kaminsky et al) describes a process for concentrating and recovering titanium and zirconium containing minerals from froth treatment tailings. Canadian Patent No. 1,088,883 (Trevoy et al) describes a dry separatory process for concentrating titanium-based and zirconium-based minerals from first stage centrifuge froth treatment tailings. Canadian Patent No. 1,326,571 (Ityokumbul et al) describes a process for recovering metal values such as titanium and zirconium from froth treatment tailings. Canadian Patent No. 2,426,113 (Reeves et al) describes a process for recovering heavy minerals from froth treatment tailings. Canadian Patent Application No. 2,548,006 (Erasmus et al) describes a process for recovering heavy minerals from froth treatment tailings. Canadian Patent No. 2,674,660 (Esmaeili et al) describes a process for treating froth treatment tailings in which the tailings are dewatered and then combusted to convert kaolin in the tailings to metakaolin, and in which calcined fines and heavy minerals may be recovered from the combustion products.

An example in the prior art of a process directed at recovering heavy minerals from tailings derived from the processing of a material other than oil sand is U.S. Pat. No. 5,106,489 (Schmidt et al), which describes a process for recovering a bulk concentrate of zircon and a bulk concentrate of rutile-ilmenite from dry plant tailings using froth flotation techniques.

There remains a need for methods for recovering heavy minerals from froth treatment tailings which can address the particular physical and chemical characteristics of froth treatment tailings and of the heavy minerals which may be contained in froth treatment tailings.

There remains a particular need for methods for producing a zirconium concentrated product from froth treatment tailings.

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

In this document, "froth flotation" means an operation in which components of a mixture are separated by passing a gas through the mixture so that the gas causes one or more components of the mixture to float toward the top of the mixture and form a froth. Froth flotation as used in this document may include the use of reagents as flotation aids including, without limitation, surfactants, depressants, activators, collectors, acids, bases, and/or frothing agents.

In this document, "froth flotation separator" includes any device or apparatus which may be used to perform froth flotation including, without limitation, a flotation cell or flotation tank, a flotation column, and/or any other suitable froth flotation apparatus, which may or may not include an agitator and/or a mixer.

In this document, "gravity separation" means an operation in which components of a mixture are separated primarily by relative settling in an aqueous medium due to gravity, and is therefore distinguished from other separation operations such as molecular sieve processes, absorption processes, adsorption processes, froth flotation processes, magnetic processes, electrical processes, electrostatic processes, enhanced gravity separation processes, etc.

In this document, "gravity separator" includes any device or apparatus which may be used to perform gravity separation including, without limitation, a gravity settling vessel, an inclined plate separator, a spiral separator, a shaker table separator, a rotary disc contactor, a thickener, and/or any other suitable device or apparatus which facilitates gravity separation, with or without the use of process aids such as flocculants and demulsifiers.

In this document, "electrostatic separation" means an operation in which components of a mixture are electrostatically charged and are then separated based upon the conductive or non-conductive properties of the components.

In this document, "electrostatic separator" includes any device or apparatus which may be used to perform electrostatic separation including, without limitation, a high tension roll separator and/or an electrostatic plate separator.

In this document, "magnetic separation" means an operation in which components of a mixture are separated based upon the magnetic or non-magnetic properties of the components.

In this document, "magnetic separator" includes any device or apparatus which may be used to perform magnetic separation including, without limitation, an induced magnet roll separator and/or a rare earth magnet roll separator.

In this document, "dry separation" means a separation operation which is typically performed on a feed material which is relatively dry (i.e., is not presented in an aqueous medium) including, without limitation, electrostatic separation and/or magnetic separation.

In this document, "wet separation" means a separation operation which is typically performed on a feed material which is mixed with water (i.e., is presented in an aqueous medium) including, without limitation, gravity separation.

In this document, "rougher stage" means a primary separation operation in which a head feed material is separated into at least one primary product component and at least one primary tailings component.

In this document, "cleaner stage" means a separation operation which is performed on a primary product component from a rougher stage.

In this document, "recleaner stage" means a separation operation which is performed on a product component from a cleaner stage or on a product component from another recleaner stage.

In this document, "scavenger stage" means a separation operation which is performed directly or indirectly on a primary tailings component from a rougher stage, directly or indirectly on a tailings component from a cleaner stage, or directly or indirectly on a tailings component from a recleaner stage.

The present invention is directed at a method for producing a zirconium concentrated product from froth treatment tailings.

The froth treatment tailings result from a process for recovering bitumen from oil sand, wherein the process for recovering bitumen from oil sand is comprised of producing a bitumen froth from the oil sand, and wherein the process for recovering bitumen from oil sand is further comprised of separating the bitumen froth tailings from the bitumen froth in a froth treatment process.

The process for recovering bitumen from oil sand may be comprised of any suitable process, including without limitation the Clark hot water process or a process based upon the Clark hot water process.

The froth treatment process may be comprised of any suitable process, including without limitation a froth treatment process utilizing a diluent such as a paraffinic type diluent or a naphthenic type diluent.

The zirconium concentrated product is comprised of a concentration of the element zirconium, which may be present in the zirconium concentrated product in various forms including, without limitation, as zirconia or zirconium oxide ($ZrO_2$) and/or as zircon or zirconium silicate ($ZrSiO_4$). Zirconium, zirconia and zircon all have a specific gravity above 4.5 and are therefore considered as "heavy minerals".

In this document, the concentration of zirconium in the zirconium concentrated product may be expressed as a concentration or as an equivalent concentration of zirconia ($ZrO_2$) (i.e., as "zirconia concentration").

The zirconium concentrated product is produced from froth treatment tailings. In some embodiments, the zirconium concentrated product may be produced from a head feed material comprising, consisting of, or consisting essentially of froth treatment tailings in their entirety. In some embodiments, the zirconium concentrated product may be produced from a head feed material comprising, consisting of, or consisting essentially of a component of froth treatment tailings.

In some embodiments, the zirconium concentrated product may be produced from a head feed material comprising, consisting of or consisting essentially of a coarse mineral material fraction of froth treatment tailings. In such embodiments, the coarse mineral material fraction may result from the separation of froth treatment tailings into a fine mineral material fraction and a coarse mineral material fraction. In such embodiments, the fine mineral material fraction may be comprised of solid mineral material which predominantly has a particle size less than about 44 microns and the coarse mineral material fraction may be comprised of solid mineral material which predominantly has a particle size greater than about 44 microns.

In some particular embodiments, the zirconium concentrated product may be produced from a head feed material comprising, consisting of, or consisting essentially of a heavy mineral concentrate which is obtained from froth treatment tailings, wherein heavy minerals which were contained in the froth treatment tailings have been concentrated in the heavy mineral concentrate.

In some embodiments, the heavy mineral concentrate may be obtained by processing a coarse mineral material fraction of froth treatment tailings to remove bitumen, water and/or fine mineral material other than heavy minerals in order to concentrate heavy minerals in the heavy mineral concentrate.

In some embodiments, a heavy mineral concentrate may be obtained from froth treatment tailings by using the method described in U.S. Patent Application Publication No. US 2011/0233115 (Moran et al) and corresponding Canadian Patent No. 2,693,879 (Moran et al), or a similar method.

In some embodiments, the heavy mineral concentrate may be characterized by a bitumen content of less than about 1 percent by weight of heavy mineral concentrate, a heavy mineral concentration of at least about 50 percent by weight of heavy mineral concentrate, and an equivalent zirconia concentration of at least about 4 percent by weight of heavy mineral concentrate.

In some embodiments, the zirconium contained in the head feed material may be present as relatively fine coarse mineral material (having a particle size between about 44 microns and about 100 microns) or as fine mineral material (having a particle size smaller than about 44 microns).

In some embodiments, the method for producing a zirconium concentrated product from the head feed material may emphasize scavenging over cleaning, due at least in part to the relatively fine particle size of the zirconium contained in the head feed material.

The zirconia concentration in the zirconium concentrated product which is produced by the method of the invention is higher than the zirconia concentration in the head feed material which is used in the invention.

In some embodiments, the zirconium concentrated product which is produced by the method of the invention may have a zirconia concentration which is greater than about 60 percent by dry weight of the zirconium concentrated product. In some embodiments, the zirconium concentrated product which is produced by the method of the invention may have a zirconia concentration which is greater than about 65 percent by dry weight of the zirconium concentrated product. In some embodiments, the zirconium concentrated product which is produced by the method of the invention may have a zirconia concentration which is greater than about 66 percent by dry weight of the zirconium concentrated product.

In a first exemplary aspect, the invention is a method for processing a heavy mineral concentrate obtained from froth treatment tailings to produce a zirconium concentrated product, wherein the froth treatment tailings result from a process for recovering bitumen from oil sand, wherein the process for recovering bitumen from oil sand is comprised of producing a bitumen froth from the oil sand, wherein the process for recovering bitumen from oil sand is further comprised of separating the froth treatment tailings from the bitumen froth in a froth treatment process, the method comprising:

(a) subjecting the heavy mineral concentrate to froth flotation to selectively recover zirconium in order to produce a flotation product;

(b) subjecting the flotation product to initial gravity separation to selectively recover zirconium in order to produce an initial gravity separation product;

(c) subjecting the initial gravity separation product to primary dry separation to selectively recover zirconium in order to produce a primary dry separation product;

(d) subjecting the primary dry separation product to finishing gravity separation to selectively recover zirconium in order to produce a finishing gravity separation product; and (e) subjecting the finishing gravity separation product to finishing dry separation to selectively recover zirconium in order to produce a finishing dry separation product.

In the first exemplary aspect, the primary dry separation may be comprised of any suitable dry separation operation or combination of dry separation operations. In some embodiments, the primary dry separation may be comprised of a primary electrostatic separation and/or a primary magnetic separation.

In the first exemplary aspect, the finishing dry separation may be comprised of any suitable dry separation operation or combination of dry separation operations. In some embodiments, the finishing dry separation may be comprised of a finishing electrostatic separation and/or a finishing magnetic separation.

In a second exemplary aspect, the invention is a method for processing a heavy mineral concentrate obtained from froth treatment tailings to produce a zirconium concentrated product, wherein the froth treatment tailings result from a process for recovering bitumen from oil sand, wherein the process for recovering bitumen from oil sand is comprised of producing a bitumen froth from the oil sand, wherein the process for recovering bitumen from oil sand is further comprised of separating the froth treatment tailings from the bitumen froth in a froth treatment process, the method comprising:

(a) subjecting the heavy mineral concentrate to froth flotation to selectively recover zirconium in order to produce a flotation product;

(b) subjecting the flotation product to initial gravity separation to selectively recover zirconium in order to produce an initial gravity separation product;

(c) subjecting the initial gravity separation product to primary electrostatic separation to selectively recover zirconium in order to produce a primary electrostatic separation product;

(d) subjecting the primary electrostatic separation product to primary magnetic separation to selectively recover zirconium in order to produce a primary magnetic separation product;

(e) subjecting the primary magnetic separation product to finishing gravity separation to selectively recover zirconium in order to produce a finishing gravity separation product;

(f) subjecting the finishing gravity separation product to finishing electrostatic separation to selectively recover zirconium in order to produce a finishing electrostatic separation product; and (g) subjecting the finishing electrostatic separation product to finishing magnetic separation to selectively recover zirconium in order to produce a finishing magnetic separation product as the zirconium concentrated product.

A purpose of the froth flotation may be to reject coarse non-valuable silicates and iron bearing minerals from the heavy mineral concentrate, thereby concentrating zirconium in the flotation product.

The froth flotation may be performed in any suitable manner and may be performed using any suitable froth flotation separator or combination of suitable froth flotation separators. The froth flotation may be comprised of a froth flotation circuit.

The froth flotation may be comprised of a single froth flotation stage or may be comprised of a plurality of froth flotation stages comprising any number of froth flotation stages. A plurality of froth flotation stages may be arranged in a configuration which comprises a rougher stage and any number of cleaner stages and scavenger stages.

In some embodiments, a plurality of froth flotation stages may be arranged in a configuration which emphasizes scavenging over cleaning in order to maximize the recovery of zirconium in the flotation product.

In some embodiments, the froth flotation may be comprised of a froth flotation circuit which is comprised of two froth flotation stages. In some embodiments, the two froth flotation stages may be arranged in a configuration which comprises a rougher stage and a scavenger stage.

In some embodiments, each of the froth flotation stages may be performed using one or more froth flotation separators.

In some embodiments, the rougher stage of the froth flotation circuit may be performed using a plurality of rougher cells comprising any number of rougher cells as froth flotation separators. In some particular embodiments, the rougher stage of the froth flotation circuit may be performed using five rougher cells as froth flotation separators.

In some embodiments, a scavenger stage of the froth flotation circuit may be performed using a plurality of scavenger cells comprising any number of scavenger cells as froth flotation separators. In some particular embodiments, a scavenger stage of the froth flotation circuit may be performed using four rougher cells as froth flotation separators.

In some embodiments, the froth flotation may be performed using one or more reagents as flotation aids. Any suitable reagent or combination of reagents may be used in the froth flotation including, without limitation, pH adjusting reagents, depressants, activators, collectors, and/or frothing agents.

In some embodiments, one or more acids or bases may be used as pH adjusting reagents to "adjust" the pH for the froth flotation to a desired pH value. The one or more acids or bases may be comprised of any suitable substance or combination of substances. In some embodiments, one or more acids such as sulphuric acid may be used as a pH adjusting reagent to provide an acidic pH in the froth flotation separators.

In some embodiments, one or more depressants may be used as reagents to "depress" one or more constituents of the feed material so that they do not report to the flotation product. The one or more depressants may be comprised of any suitable substance or combination of substances. In some embodiments, the one or more depressants may be comprised of one or more starches, which may be used to depress constituents such as pyrite and/or low quality titanium minerals. In some embodiments, the one or more starches may be comprised of wheat starch. In some embodiments, the wheat starch may be an unmodified wheat starch. In some embodiments, the wheat starch may be a digested wheat starch.

In some embodiments, one or more activators may be used to "activate" one or more constituents of the feed material so that they can be floated and thus report to the flotation product. The one or more activators may be comprised of any suitable substance or combination of substances. In some embodiments, the activator may be comprised of one or more sources of fluoride ions. In some embodiments, the one or more sources of fluoride ions may be comprised of one or more sodium fluoride compounds. In some embodiments, the one or more sodium fluoride compounds may be comprised of sodium fluorosilicate ($Na_2SiF_6$).

In some embodiments, one or more collectors may be used to assist in causing one or more constituents of the feed material to report to the flotation product. The one or more collectors may be comprised of any suitable substance or combination of substances. In some embodiments, the one or more collectors may be comprised of one or more cationic collectors. In some embodiments, the one or more cationic collectors may be comprised of a Flotigam™ cationic collector, such as Flotigam 2835 and/or Flotigam EDA.

In some embodiments, one or more frothing agents may be used to assist in producing the flotation product. The one or more frothing agents may be comprised of any suitable substance or combination of substances. In some embodiments, the one or more frothing agents may be comprised of methyl isobutyl carbinol (MIBC) and/or C-007™ frother, manufactured by Ciba Specialty Chemicals (now BASF Schweiz AG).

A purpose of the initial gravity separation may be to reject aluminosilicates such as kyanite from the flotation product, thereby further concentrating zirconium in the initial gravity separation product.

The initial gravity separation may be performed in any suitable manner and may be performed using any suitable gravity separator or combination of suitable gravity separators. The initial gravity separation may be comprised of an initial gravity separation circuit.

The initial gravity separation may be comprised of a single initial gravity separation stage or may be comprised of a plurality of initial gravity separation stages comprising any number of initial gravity separation stages. A plurality of initial gravity separation stages may be arranged in a configuration which comprises a rougher stage and any number of cleaner stages and scavenger stages.

In some embodiments, a plurality of initial gravity separation stages may be arranged in a configuration which emphasizes scavenging over cleaning in order to maximize the recovery of zirconium in the initial gravity separation product.

In some embodiments, the initial gravity separation may be comprised of an initial gravity separation circuit which is comprised of at least four initial gravity separation stages. In some embodiments, an initial gravity separation circuit which is comprised of at least four initial gravity separation stages may be arranged in a configuration which comprises a rougher stage, at least one cleaner stage, and a plurality of scavenger stages.

In some embodiments, the initial gravity separation may be comprised of seven initial gravity separation stages.

In some embodiments, each of the initial gravity separation stages may be performed using a spiral separator as a gravity separator.

A purpose of the primary dry separation may be to reject electrically conductive minerals such as ilmenite and leucoxene and non-conductive iron-bearing magnetic minerals such as tourmaline and garnet from the initial gravity separation product, thereby further concentrating zirconium in the primary dry separation product.

In some embodiments, the primary dry separation may be comprised of primary electrostatic separation to reject electrically conductive minerals. In some embodiments, the primary dry separation may be comprised of primary magnetic separation to reject magnetic minerals. In some embodiments, the primary dry separation may be comprised of both primary electrostatic separation and primary magnetic separation.

The primary dry separation may be performed in any suitable manner and may be performed using any suitable apparatus or combination of suitable apparatus including, without limitation, electrostatic separators and/or magnetic separators. The primary dry separation may be comprised of a primary electrostatic separation circuit and/or a primary magnetic separation circuit.

The primary electrostatic separation may be comprised of a single primary electrostatic separation stage or may be comprised of a plurality of primary electrostatic separation stages comprising any number of primary electrostatic separation stages. A plurality of primary electrostatic separation stages may be arranged in a configuration which comprises a rougher stage and any number of cleaner stages and scavenger stages.

In some embodiments, a plurality of primary electrostatic separation stages may be arranged in a configuration which emphasizes scavenging over cleaning in order to maximize the recovery of zirconium in the primary electrostatic separation product.

In some embodiments, the primary electrostatic separation may be comprised of a primary electrostatic separation circuit comprising at least four primary electrostatic separation stages. In some embodiments, a primary electrostatic separation circuit which is comprised of at least four primary electrostatic separation stages may be arranged in a configuration which comprises a rougher stage, at least one cleaner stage, and a plurality of scavenger stages.

In some embodiments, the primary electrostatic separation may be comprised of five primary electrostatic separation stages.

In some embodiments, each of the primary electrostatic separation stages may be performed using a high tension roll separator.

The primary magnetic separation may be comprised of a single primary magnetic separation stage or may be comprised of a plurality of primary magnetic separation stages comprising any number of primary magnetic separation stages. A plurality of primary magnetic separation stages may be arranged in a configuration which comprises a rougher stage and any number of cleaner stages and scavenger stages.

In some embodiments, a plurality of primary magnetic separation stages may be arranged in a configuration which emphasizes scavenging over cleaning in order to maximize the recovery of zirconium in the primary magnetic separation product.

In some embodiments, the primary magnetic separation may be comprised of a primary magnetic separation circuit comprising at least two primary magnetic separation stages. In some embodiments, a primary magnetic separation circuit which is comprised of at least two primary magnetic separation stages may be arranged in a configuration which comprises a rougher stage and at least one scavenger stage.

In some embodiments, the primary magnetic separation may be comprised of two primary electrostatic separation stages.

In some embodiments, each of the primary magnetic separation stages may be performed using a rare earth magnet roll separator. The rare earth magnet roll separators may be comprised of any suitable number of rare earth magnet rolls.

In some embodiments, the rare earth magnet roll separator which is used in the rougher stage of the primary magnetic separation circuit may be comprised of three rare earth magnet rolls. In some embodiments, the rare earth magnet roll separators which are used in the cleaner stages of the primary magnetic separation circuit may be comprised of three rare earth magnet rolls. In some embodiments, the rare earth magnet roll separators which are used in the scavenger stages of the primary magnetic separation circuit may be comprised of three rare earth magnet rolls.

A purpose of the finishing gravity separation may be to reject additional aluminosilicates from the primary magnetic separation product, thereby further concentrating zirconium in the finishing gravity separation product.

The finishing gravity separation may be performed in any suitable manner and may be performed using any suitable gravity separator or combination of suitable gravity separators. The finishing gravity separation may be comprised of a finishing gravity separation circuit.

The finishing gravity separation may be comprised of a single finishing gravity separation stage or may be comprised of a plurality of finishing gravity separation stages comprising any number of finishing gravity separation stages. A plurality of finishing gravity separation stages may be arranged in a configuration which comprises a rougher stage and any number of cleaner stages and scavenger stages.

In some embodiments, a plurality of finishing gravity separation stages may be arranged in a configuration which emphasizes scavenging over cleaning in order to maximize the recovery of zirconium in the finishing gravity separation product.

In some embodiments, the finishing gravity separation may be comprised of a finishing gravity separation circuit which is comprised of at least four finishing gravity separation stages. In some embodiments, a finishing gravity separation circuit which is comprised of at least four finishing gravity separation stages may be arranged in a configuration which comprises a rougher stage, at least one cleaner stage, and a plurality of scavenger stages.

In some embodiments, the finishing gravity separation may be comprised of four finishing gravity separation stages.

In some embodiments, each of the finishing gravity separation stages may be performed using a shaker table separator as a gravity separator.

A purpose of the finishing dry separation may be to reject additional non-zirconium contaminants from the finishing gravity separation product, thereby "polishing" and further concentrating zirconium in the finishing dry separation product.

In some embodiments, the finishing dry separation may be comprised of finishing electrostatic separation to reject electrically conductive minerals. In some embodiments, the finishing dry separation may be comprised of finishing magnetic separation to reject magnetic minerals. In some embodiments, the finishing dry separation may be comprised of both finishing electrostatic separation and finishing magnetic separation.

The finishing dry separation may be performed in any suitable manner and may be performed using any suitable apparatus or combination of suitable apparatus including, without limitation, electrostatic separators and/or magnetic separators. The finishing dry separation may be comprised of a finishing electrostatic separation circuit and/or a finishing magnetic separation circuit.

The finishing electrostatic separation may be comprised of a single finishing electrostatic separation stage or may be comprised of a plurality of finishing electrostatic separation stages comprising any number of finishing electrostatic separation stages. A plurality of finishing electrostatic separation stages may be arranged in a configuration which comprises a rougher stage and any number of cleaner stages and scavenger stages.

In some embodiments, a plurality of finishing electrostatic separation stages may be arranged in a configuration which emphasizes scavenging over cleaning in order to maximize the recovery of zirconium in the finishing electrostatic separation product.

In some embodiments, the finishing electrostatic separation may be comprised of a finishing electrostatic separation circuit comprising at least four finishing electrostatic separation stages. In some embodiments, a finishing electrostatic separation circuit which is comprised of at least four finishing electrostatic separation stages may be arranged in a configuration which comprises a rougher stage, at least one cleaner stage, and a plurality of scavenger stages.

In some embodiments, the finishing electrostatic separation may be comprised of four finishing electrostatic separation stages.

In some embodiments, each of the finishing electrostatic separation stages may be performed using a high tension roll separator.

The finishing magnetic separation may be comprised of a single finishing magnetic separation stage or may be comprised of a plurality of finishing magnetic separation stages comprising any number of finishing magnetic separation stages. A plurality of finishing magnetic separation stages may be arranged in a configuration which comprises a rougher stage and any number of cleaner stages and scavenger stages.

In some embodiments, a plurality of finishing magnetic separation stages may be arranged in a configuration which emphasizes scavenging over cleaning in order to maximize the recovery of zirconium in the finishing magnetic separation product.

In some embodiments, the finishing magnetic separation may be comprised of a finishing magnetic separation circuit comprising at least three finishing magnetic separation stages. In some embodiments, a finishing magnetic separation circuit which is comprised of at least three finishing magnetic separation stages may be arranged in a configuration which comprises a rougher stage and at least one scavenger stage.

In some embodiments, the finishing magnetic separation may be comprised of four finishing electrostatic separation stages.

In some embodiments, each of the finishing magnetic separation stages may be performed using an induced magnet roll separator. The induced magnet roll separators may be comprised of any suitable number of induced magnet rolls.

In some embodiments, the induced magnet roll separator which is used in the rougher stage of the finishing magnetic separation circuit may be comprised of a single induced magnet roll. In some embodiments, the induced magnet roll separators which are used in the cleaner stages of the finishing magnetic separation circuit may be comprised of a single induced magnet roll. In some embodiments, the induced magnet roll separators which are used in the scavenger stage of the finishing magnetic separation circuit may be comprised of a single induced magnet roll.

In some embodiments, the finishing dry separation may be comprised of removing an oversize fraction from a feed material after the finishing gravity separation is performed. In some embodiments, the oversize fraction may have a particle size greater than about 100 microns.

In some embodiments, the oversize fraction may be removed before the finishing electrostatic separation is performed. In some embodiments, the oversize fraction may be removed after the finishing electrostatic separation is performed, but before the finishing magnetic separation is performed. In some embodiments, the oversize fraction may be removed after the finishing magnetic separation is performed.

The oversize fraction may be removed in any suitable manner. In some embodiments, the oversize fraction may be removed using a screen, such as a vibrating screen.

In some particular embodiments, the finishing dry separation may be comprised of removing an oversize fraction from the finishing electrostatic separation product before subjecting the finishing electrostatic separation product to the finishing magnetic separation.

In some such embodiments, the oversize fraction may have a particle size greater than about 100 microns, so that the finishing electrostatic separation product which is subjected to the finishing magnetic separation has a particle size which is no greater than about 100 microns.

In some such embodiments, the oversize fraction may be removed from the finishing electrostatic separation product using a screen, such as a vibrating screen.

BRIEF DESCRIPTION OF DRAWINGS

Embodiments of the invention will now be described with reference to the accompanying drawings, in which:

FIG. 8 is a Table entitled: "Heavy Mineral Concentrate (HMC) Feed Material", which provides examples of heavy mineral concentrate (HMC) samples having compositions which may be suitable for use as a head feed material in the practice of the invention.

FIG. 9 is a Table entitled: "Froth Flotation (Operating Conditions)", which provides exemplary operating conditions for the exemplary embodiment of the froth flotation circuit depicted in FIG. 1.

FIG. 12 is a Table entitled: "Overall Material Balance", which provides an exemplary material balance for the exemplary embodiment depicted in FIGS. 1-7.

FIG. 13 is a Table entitled: "Zirconium Recoveries", which provides a summary of zirconium recoveries and cumulative zirconium recoveries from the exemplary material balance of FIG. 12.

DETAILED DESCRIPTION

An exemplary embodiment of the invention is depicted and described in FIGS. 1-13.

As depicted and described in FIGS. 1-13, the exemplary embodiment is comprised of a sequence of mineral processing operations conducted on a heavy mineral concentrate (HMC) as a head feed material. The sequence of mineral processing operations provides a method (10) for processing the heavy mineral concentrate (12) to produce a zirconium concentrated product (14).

Figure 1:
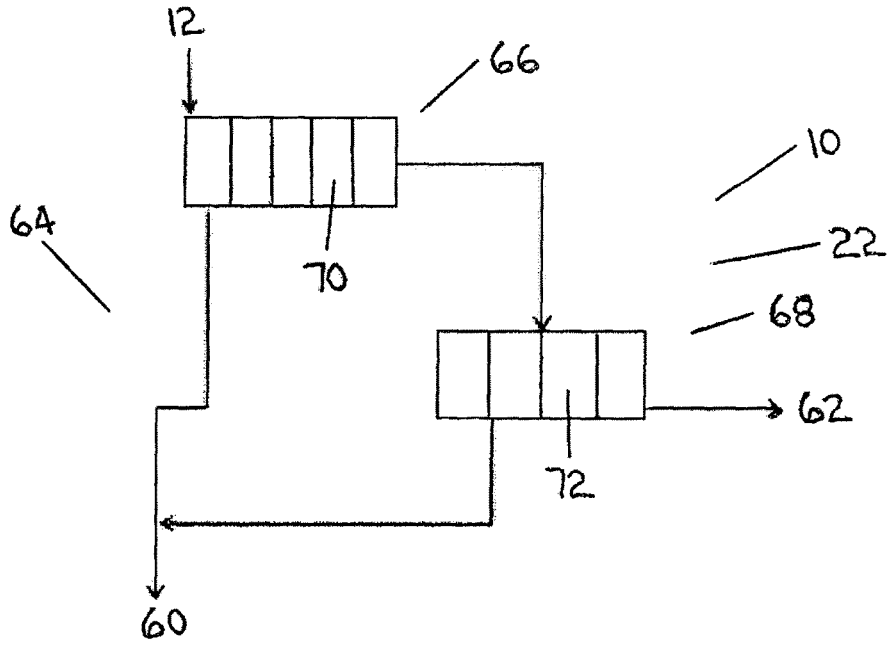
FIG. 1 is a flow sheet depicting an exemplary embodiment of a froth flotation circuit according to the invention.
Figure 2:
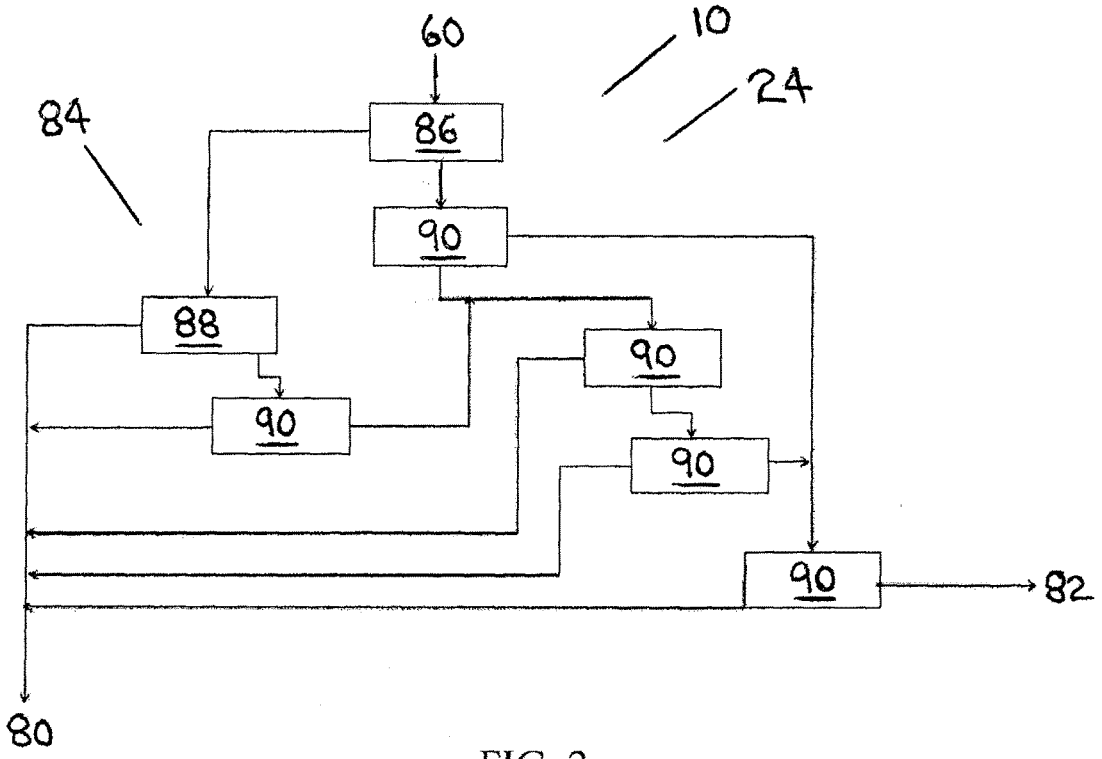
FIG. 2 is a flow sheet depicting an exemplary embodiment of a primary gravity separation circuit according to the invention.
Figure 3:
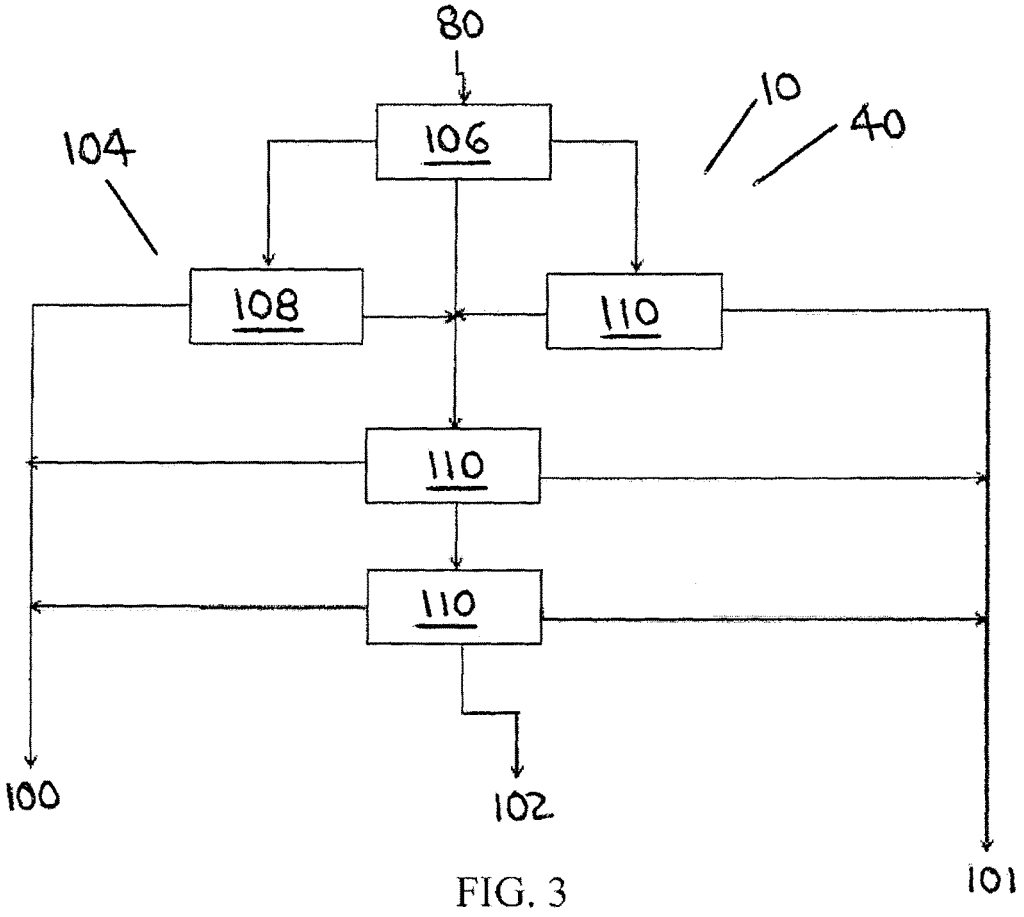
FIG. 3 is a flow sheet depicting an exemplary embodiment of a primary electrostatic separation circuit according to the invention.
Figure 4:
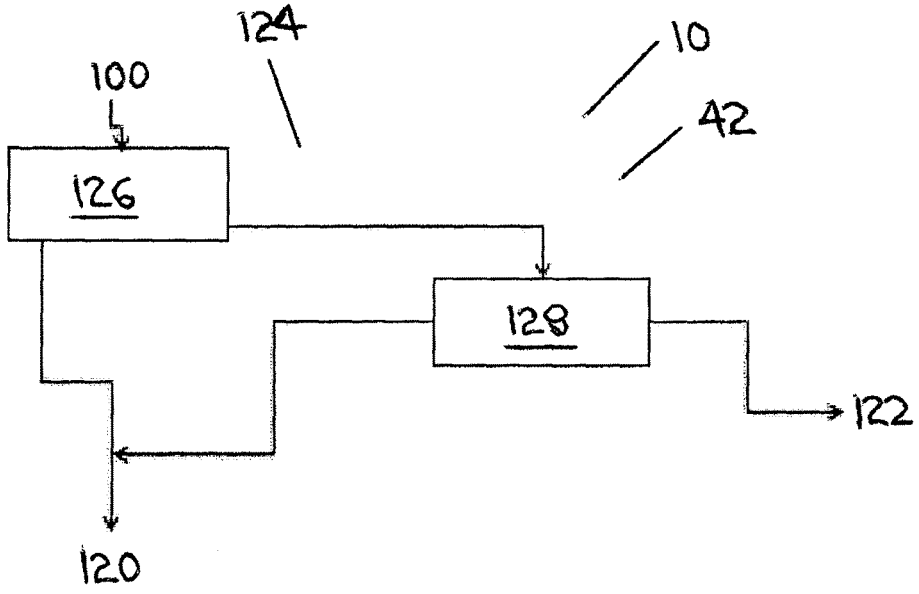
FIG. 4 is a flow sheet depicting an exemplary embodiment of a primary magnetic separation circuit according to the invention.
Figure 5:
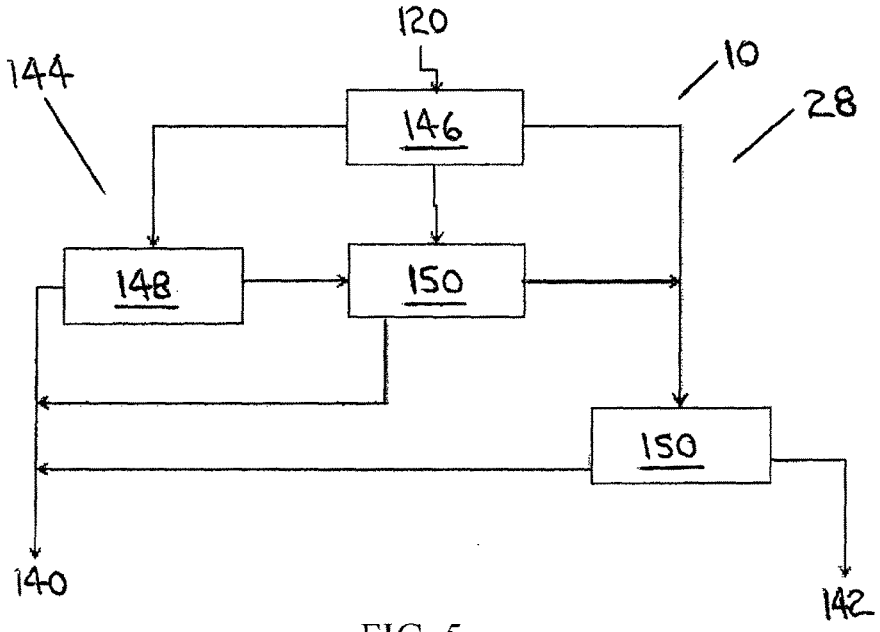
FIG. 5 is a flow sheet depicting an exemplary embodiment of a finishing gravity separation circuit according to the invention.
Figure 6:
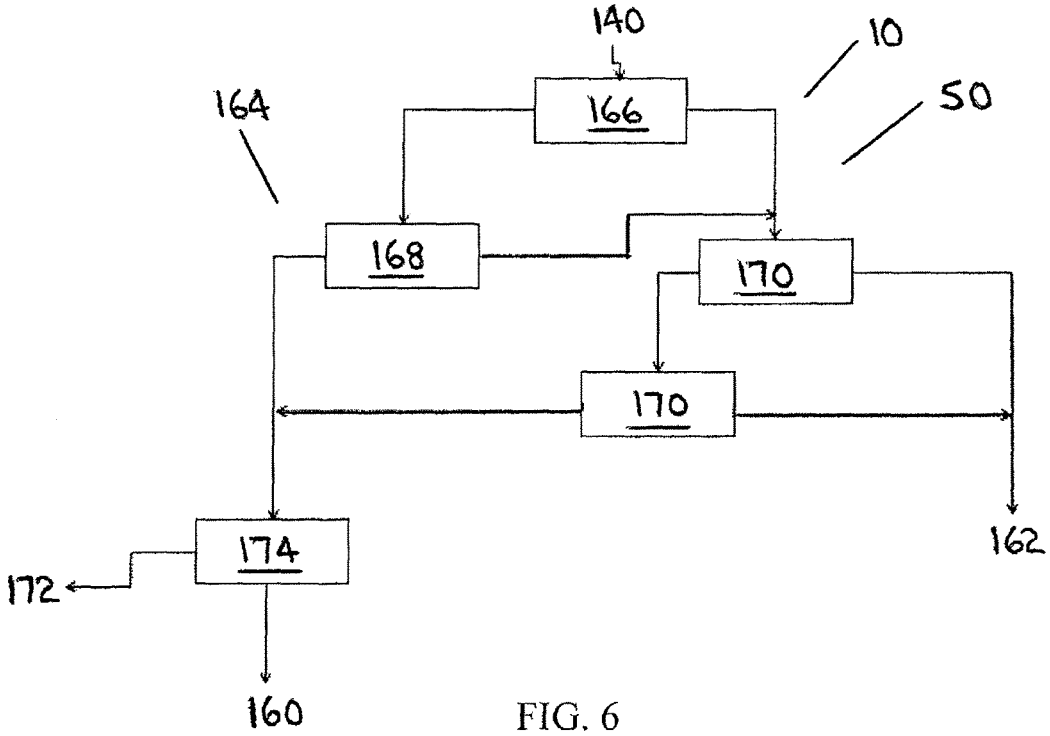
FIG. 6 is a flow sheet depicting an exemplary embodiment of a finishing electrostatic separation circuit according to the invention.
Figure 7:
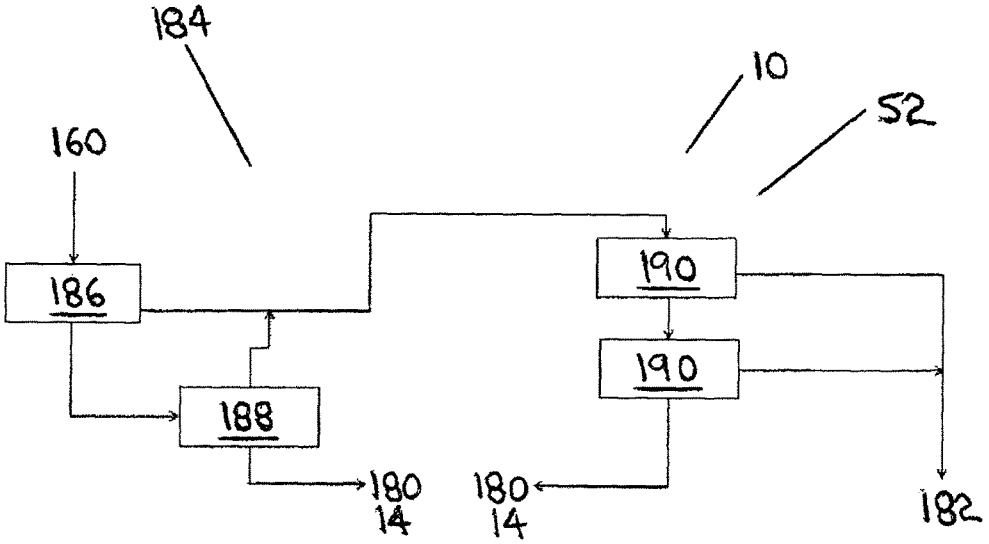
FIG. 7 is a flow sheet depicting an exemplary embodiment of a finishing magnetic separation circuit according to the invention.

Referring to FIGS. 1-7, the sequence of mineral processing operations in the exemplary embodiment is comprised of froth flotation (22), initial gravity separation (24), primary dry separation (26), finishing gravity separation (28), and finishing dry separation (30). Referring to FIGS. 3-4, in the exemplary embodiment, the primary dry separation (24) is comprised of primary electrostatic separation (40) and primary magnetic separation (42). Referring to FIGS. 6-7, in the exemplary embodiment, the finishing dry separation (28) is comprised of finishing electrostatic separation (50) and finishing magnetic separation (52).

In the exemplary embodiment, the heavy mineral concentrate (12) is obtained from processing a coarse mineral material fraction of froth treatment tailings to remove bitumen, water and/or fine mineral material other than heavy minerals, thereby concentrating heavy minerals in the heavy mineral concentrate. An exemplary method for producing a heavy mineral concentrate from a coarse mineral material fraction of froth treatment tailings is described in U.S. Patent Application No. US 2011/0233115 (Moran et al) and corresponding Canadian Patent No. 2,693,879 (Moran et al).

Figure 10:
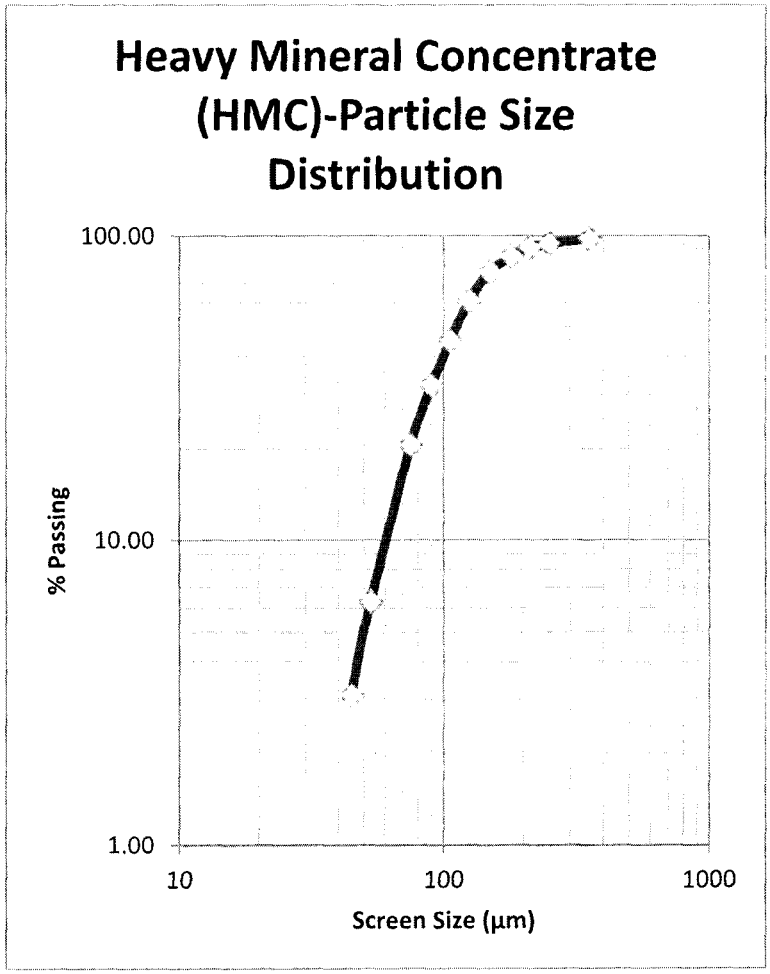
FIG. 10 is a Graph entitled: "Heavy Mineral Concentrate (HMC)-Particle Size Distribution", which provides an exemplary particle size distribution for a heavy mineral concentrate (HMC) material which may be suitable for use as a head feed material in the practice of the invention.

Referring to FIG. 8 and FIG. 10, the heavy mineral concentrate (12) which is used as a head feed material in the exemplary embodiment may comprise a bitumen content of less than about 1 percent by weight of heavy mineral concentrate, a heavy mineral concentration of at least about 50 percent by weight of heavy mineral concentrate, an equivalent zirconia ($ZrO_2$) concentration of at least about 4 percent by weight of heavy mineral concentrate, and a particle size distribution in which at least about 30 percent by weight of the heavy mineral concentrate has a particle size smaller than about 100 microns.

Referring to FIG. 1 and FIG. 9, in the exemplary embodiment, the heavy mineral concentrate (12) as a head feed material is first subjected to the froth flotation (22) to selectively recover zirconium in order to produce a flotation product (60) and froth flotation tailings (62). In the exemplary embodiment, the flotation product (60) is produced in the froth flotation (22) at least in part by rejecting coarse non-valuable silicates and iron bearing minerals from the heavy mineral concentrate (12).

In the exemplary embodiment, the froth flotation (22) is arranged in a configuration which emphasizes scavenging over cleaning.

Referring again to FIG. 1, in the exemplary embodiment, the froth flotation (22) is comprised of a froth flotation circuit (64) comprising a rougher stage (66) and a scavenger stage (68). Referring to FIG. 9, in the exemplary embodiment, the rougher stage (66) of the froth flotation circuit (64) performed using five rougher cells (70) arranged in series as a froth flotation separator, and the scavenger stage (68) is performed using four scavenger cells (72) arranged in series as a froth flotation separator.

Exemplary operating conditions for the froth flotation circuit (64) in the exemplary embodiment are provided in FIG. 9.

In the exemplary embodiment, the froth flotation circuit (64) is caused to be somewhat selective for zirconium by controlling the pH of the froth flotation slurry in the acidic regime (i.e., a pH of less than about 2) in order to limit interactions between air bubbles and silicates. In the exemplary embodiment, the froth flotation slurry is further modulated in order to improve the selectivity of the froth flotation circuit (64) for zirconium and to suppress the flotation of aluminum and titanium minerals. Unmodified wheat starch is used as a depressant to suppress the flotation of ilmenite and leucoxene. Sodium fluorosilicate is used as an activator to activate the flotation of zirconium bearing minerals. Flotigam 2835 and Flotigam EDA are used as collectors to provide improved selectivity for zirconium over aluminum. C-007 is used as a frothing agent to provide increased stability to the froth produced in the froth flotation circuit (64).

In other embodiments, a different configuration for the froth flotation (22) may be utilized, including the number and configuration of the froth flotation stages, the type of froth flotation separator, the types of froth flotation reagents, and the operating conditions, depending upon the requirements of the head feed material.

Referring to FIG. 2, in the exemplary embodiment, after the froth flotation (22) the flotation product (60) is subjected to the initial gravity separation (24) to selectively recover zirconium in order to produce an initial gravity separation product (80) and initial gravity separation tailings (82). In the exemplary embodiment, the initial gravity separation product (80) is produced in the initial gravity separation (24) at least in part by rejecting aluminosilicates such as kyanite from the flotation product (60).

In the exemplary embodiment, the initial gravity separation (24) is arranged in a configuration which emphasizes scavenging over cleaning.

Referring again to FIG. 2, in the exemplary embodiment, the initial gravity separation (24) is comprised of an initial gravity separation circuit (84) comprising seven initial gravity separation stages. In the exemplary embodiment, the seven initial gravity separation stages are comprised of a rougher stage (86), a cleaner stage (88), and five scavenger stages (90). In the exemplary embodiment, each of the seven initial gravity separation stages is performed using a spiral separator, or alternatively, a shaker table as a gravity separator.

In the exemplary embodiment, the initial gravity separation slurry has a total solid material content of at least about 35 percent in the rougher stage (86) of the initial gravity separation circuit (84).

In other embodiments, a different configuration for the initial gravity separation (24) may be utilized, including the number and configuration of the initial gravity separation stages, the type of gravity separator, and the operating conditions, depending upon the requirements of the flotation product (60).

Referring to FIG. 3, after the initial gravity separation (24), the initial gravity separation product (80) is subjected to the primary electrostatic separation (40) to produce a primary electrostatic separation product (100), primary electrostatic separation tailings (101), and primary electrostatic separation middlings (102). In the exemplary embodiment, the primary electrostatic separation product (100) is produced in the primary electrostatic separation (40) at least in part by rejecting electrically conductive minerals such as ilmenite and leucoxene from the initial gravity separation product (70).

In the exemplary embodiment, the primary electrostatic separation (40) is arranged in a configuration which emphasizes scavenging over cleaning.

Referring again to FIG. 3, in the exemplary embodiment, the primary electrostatic separation (40) is comprised of a primary electrostatic separation circuit (104) comprising five primary electrostatic separation stages. In the exemplary embodiment, the five primary electrostatic separation stages are comprised of a rougher stage (106), a cleaner stage (108) and three scavenger stages (110).

In the exemplary embodiment, each of the five primary electrostatic separation stages is performed using a high tension roll separator such as an Ore Kinetics Coronastat™ high tension roll separator as an electrostatic separator. In the exemplary embodiment, the high tension roll separators may be operated at an operating temperature of about 90 degrees Celsius, at a voltage of about 23-24 kilovolts, and at a roll speed of about 230-240 rpm.

In other embodiments, a different configuration for the primary electrostatic separation (40) may be utilized, including the number and configuration of the primary electrostatic separation stages, the type of electrostatic separator, and the operating conditions, depending upon the requirements of the initial gravity separation product (80).

Referring to FIG. 4, in the preferred embodiment, after the primary electrostatic separation (40) the primary electrostatic separation product (100) is subjected to the primary magnetic separation (42) to selectively recover zirconium in order to produce a primary magnetic separation product (120) and primary magnetic separation tailings (122). In the exemplary embodiment, the primary magnetic separation product (120) is produced by the primary magnetic separation at least in part by rejecting non-conductive iron-bearing magnetic minerals such as tourmaline and garnet from the primary electrostatic separation product (100).

In the exemplary embodiment, the primary magnetic separation (42) is arranged in a configuration which emphasizes scavenging over cleaning.

Referring again to FIG. 4, in the exemplary embodiment, the primary magnetic separation (42) is comprised of a primary magnetic separation circuit (124) comprising two primary magnetic separation stages. In the exemplary embodiment, the two primary magnetic separation stages are comprised of a rougher stage (126) and a scavenger stage (128).

In the exemplary embodiment, both of the primary magnetic separation stages are performed using a rare earth magnet roll separator as a magnetic separator. In the exemplary embodiment, both of the rare earth magnet roll separators are comprised of three rare earth magnet rolls. In the exemplary embodiment, the rare earth magnet roll separator in the rougher stage (126) is operated at about 200 rpm, and the rare earth magnet roll separator in the scavenger stage (128) is operated at about 225 rpm.

In other embodiments, a different configuration for the primary magnetic separation (42) may be utilized, including the number and configuration of the primary magnetic separation stages, the type of magnetic separator, and the operating conditions, depending upon the requirements of the primary electrostatic separation product (100).

Referring to FIG. 5, in the exemplary embodiment, after the primary magnetic separation (42) the primary magnetic separation product (120) is subjected to the finishing gravity separation (28) to selectively recover zirconium in order to produce a finishing gravity separation product (140) and finishing gravity separation tailings (142). In the exemplary embodiment, the finishing gravity separation product (140) is produced in the initial gravity separation (24) at least in part by rejecting additional aluminosilicates from the primary magnetic separation product (120).

In the exemplary embodiment, the finishing gravity separation (28) is arranged in a configuration which emphasizes scavenging over cleaning.

Referring again to FIG. 5, in the exemplary embodiment, the finishing gravity separation (24) is comprised of a finishing gravity separation circuit (144) comprising four finishing gravity separation stages. In the exemplary embodiment, the four finishing gravity separation stages are comprised of a rougher stage (146), a cleaner stage (148), and two scavenger stages (150). In the exemplary embodiment, each of the four finishing gravity separation stages is performed using a shaker table as a gravity separator.

In the exemplary embodiment, the finishing gravity separation slurry has a total solid material content of at least about 35 percent in the rougher stage (84) of the finishing gravity separation circuit (144).

In the exemplary embodiment, the finishing gravity separation (28) is performed by operating each shaker table carefully to maximize the amount of material which accumulates between each of the riffles of the shaker table. A reason for this is that due to the relatively fine particle size of the zirconium contained in the primary magnetic separation product (120), the zirconium may tend to become commingled with the relatively lighter material having a relatively coarse particle size. By attempting to fill the riffles, it can be ensured that a maximum amount of the zirconium will be captured and transported to the product sides of the shaker tables.

In other embodiments, a different configuration for the finishing gravity separation (28) may be utilized, including the number and configuration of the initial gravity separation stages, the type of gravity separator, and the operating conditions, depending upon the requirements of the primary magnetic separation product (120).

Referring to FIG. 6, after the finishing gravity separation (28), the finishing gravity separation product (140) is subjected to the finishing electrostatic separation (50) to produce a finishing electrostatic separation product (160) and finishing electrostatic separation tailings (162). In the exemplary embodiment, the finishing electrostatic separation product (100) is produced in the finishing electrostatic separation (50) at least in part by rejecting additional non-zirconium contaminants from the finishing gravity separation product (140).

In the exemplary embodiment, the finishing electrostatic separation (50) is arranged in a configuration which emphasizes scavenging over cleaning.

Referring again to FIG. 6, in the exemplary embodiment, the finishing electrostatic separation (50) is comprised of a finishing electrostatic separation circuit (164) comprising four finishing electrostatic separation stages. In the exemplary embodiment, the four finishing electrostatic separation stages are comprised of a rougher stage (166), a cleaner stage (168) and two scavenger stages (170).

In the exemplary embodiment, each of the four finishing electrostatic separation stages is performed using a high tension roll separator such as an Ore Kinetics Coronastat™ high tension roll separator as an electrostatic separator. In the exemplary embodiment, the high tension roll separators may be operated at an operating temperature of about 90 degrees Celsius, at a voltage of about 23-24 kilovolts, and at a roll speed of about 230-240 rpm.

In other embodiments, a different configuration for the finishing electrostatic separation (50) may be utilized, including the number and configuration of the finishing electrostatic separation stages, the type of electrostatic separator, and the operating conditions, depending upon the requirements of the finishing gravity separation product (140).

Referring to FIG. 7, in the preferred embodiment, after the finishing electrostatic separation (50) the finishing electrostatic separation product (160) is subjected to the finishing magnetic separation (52) to selectively recover zirconium in order to produce a finishing magnetic separation product (180) and finishing magnetic separation tailings (182). In the exemplary embodiment, the finishing magnetic separation product (180) is produced by the finishing magnetic separation (52) at least in part by rejecting additional non-zirconium contaminants from the finishing electrostatic separation product (160).

In the exemplary embodiment, the finishing magnetic separation product (180) is the zirconium concentrated product (14).

Referring again to FIG. 6, in the exemplary embodiment, an oversize fraction (172) is removed from the finishing electrostatic separation product (160) before the finishing electrostatic separation product (160) is subjected to the finishing magnetic separation (52). In the exemplary embodiment, the oversize fraction (172) has a particle size greater than about 100 microns. In the exemplary embodiment, the oversize fraction (172) is removed by screening (174) using a vibrating screen.

In the exemplary embodiment, the finishing magnetic separation (52) is arranged in a configuration which emphasizes scavenging over cleaning.

Referring again to FIG. 7, in the exemplary embodiment, the finishing magnetic separation (52) is comprised of a finishing magnetic separation circuit (184) comprising four finishing magnetic separation stages. In the exemplary embodiment, the four finishing magnetic separation stages are comprised of a rougher stage (186), a cleaner stage (188), and two scavenger stages (188).

In the exemplary embodiment, each of the finishing magnetic separation stages is performed using an induced magnet roll separator as a magnetic separator. In the exemplary embodiment, each of the induced magnet roll separators is comprised of a single induced magnet roll. In the exemplary embodiment, each of the induced magnet roll separators is operated at about 150 rpm.

In other embodiments, a different configuration for the induced magnetic separation (52) may be utilized, including the number and configuration of the induced magnetic separation stages, the type of magnetic separator, and the operating conditions, depending upon the requirements of the finishing electrostatic separation product (160).

Referring to FIG. 12, an exemplary overall material balance is provided for the exemplary embodiment. The exemplary overall material balance in FIG. 12 represents results from experimental pilot plant testing of the exemplary embodiment.

The pilot plant testing was conducted from a 60 kilogram batch of heavy mineral concentrate (12) having a composition consistent with the samples described in FIG. 8 as a head feed material. The method of the exemplary embodiment was performed in a "straight-through" manner in which each circuit was handled batch-wise with no recombination of materials at any stage. Masses were recorded as appropriate and samples were retained to facilitate material balance closure and recovery calculations.

Samples were collected in replicate to assess variability. Six samples were collected in the froth flotation circuit (64) and the initial gravity separation circuit (84). These samples were subjected to both heavy liquid separation and x-ray fluorescence analyses. Three samples were collected in the primary electrostatic separation circuit (104), the primary magnetic separation circuit (124), the finishing gravity separation circuit (144), the finishing electrostatic separation circuit (164) and the finishing magnetic separation circuit (184). These samples were analyzed by x-ray fluorescence alone.

The entire exemplary embodiment was operated live using a microscope to assess the quality of the process streams, allowing for minor gentle touches to each circuit operation as processing proceeded. These minor gentle touches, where applied, were implemented only at the start of the circuits.

The experimental setup for the pilot plant testing was as follows:

1. the froth flotation (22) was performed using a Denver D-12™ laboratory froth flotation unit and a Metso D-12™ laboratory froth flotation unit as froth flotation separators, operated in parallel to reduce processing time by half. Both froth flotation units used a standard processing box of 8 liters and were operated at about 12,500 rpm. The air induction was modulated to maintain a froth height that required active paddling to push over the product weir;
2. although the exemplary embodiment contemplates the use of spiral separators as gravity separators in the initial gravity separation (24), both the initial gravity separation (24) and the finishing gravity separation (28) in the pilot plant testing was performed using Holman-Wiley Model 800™ laboratory shaker tables as gravity separators. The shaker tables were operated at a titre water rate of about 1.8 kg/min, a stroke rate of about 288/min, a stroke of about 0.5 inches (about 1.3 centimeters), a slurry feed rate of about 2.5 kg/min, and deck angles of about 1.5 degrees parallel to the riffles and about 1 degree perpendicular to the riffles;
3. the primary electrostatic separation (40) and the finishing electrostatic separation (50) in the pilot plant testing were both performed using a laboratory Ore Kinetics Coronastat™ high tension roll separator as an electrostatic separator, equipped with an EVO II electrode. The high tension roll separator was operated with a roll speed of about 230-240 rpm, a grounded potential at the ionizing element of about 23-25 kilovolts, and a feed rate of about 47 kg/hour;
4. the primary magnetic separation (42) in the pilot plant testing was performed using a Reading™ rare earth magnet roll separator (Model 300573R) as a magnetic separator, operating at a roll speed of about 225-250 rpm, and a feed rate of about 82 kg/hour;
5. the finishing magnetic separation (52) in the pilot plant testing was performed using an HMD™ induced magnet roll separator (IMRS: Model 1-1-100) as a magnetic separator, operating at a roll speed of about 150 rpm, a magnetic intensity generated by about 8 amperes across the magnet, and a feed rate of about 42 kg/hour; and
6. a vibrating screen (Eriez™) was used in the pilot plant testing to deslime process streams (−38 microns) throughout the circuits as well as to remove the oversize fraction (+106 microns) from the finishing electrostatic separation product (160) before performing the finishing magnetic separation (52).

The exemplary material balance in FIG. 12 has been "normalized" by upscaling to indicate 100 kilograms of heavy mineral concentrate as the head feed material.

Figure 11:
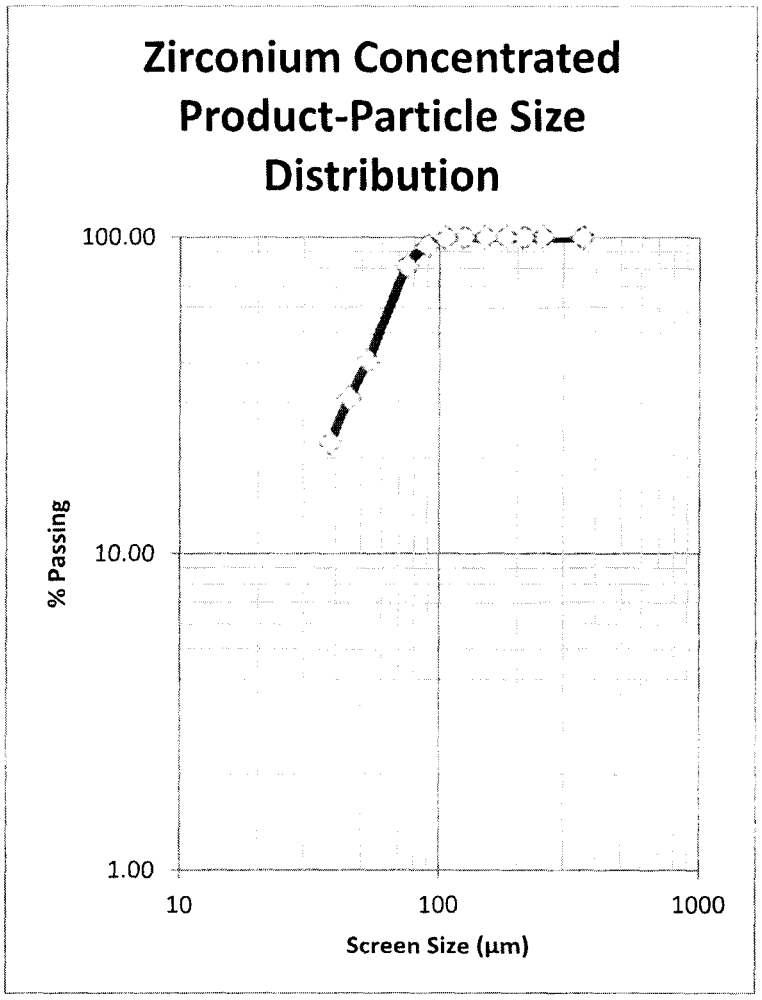
FIG. 11 is a Graph entitled: "Zirconium Concentrated Product-Particle Size Distribution", which provides an exemplary particle size distribution for a zirconium concentrated product which may be produced by the exemplary embodiment depicted in FIGS. 1-7.

Referring to FIG. 11, an exemplary particle size distribution for the zirconium concentrated product (14) is provided. Referring to FIG. 13, zirconium recoveries, based upon the exemplary material balance of FIG. 12, are provided.

From FIG. 11, it can be seen that the zirconium concentrated product (14) has a particle size distribution in which about 70 percent of the particles have a particle size of between about 44 microns and about 100 microns, and about 30 percent of the particles have a particle size smaller than about 44 microns.

From FIG. 12 and FIG. 13, it can be seen that the pilot plant testing of the exemplary embodiment achieved a cumulative zirconium recovery from the heavy mineral concentrate (12) in the zirconium concentrated product (14) of about 71.4 percent, and an equivalent $ZrO_2$ concentration (or zirconium grade) of greater than about 66 percent (i.e., between about 66 percent and about 67 percent) by weight of the zirconium concentrated product.

From FIG. 12, it can also be seen that the zirconium concentrated product exhibited a $TiO_2$ concentration of less than about 0.3 percent by weight of the zirconium concentrated product, an $Al_2O_3$ concentration of less than about 0.2 percent by weight of the zirconium concentrated product, and a $Fe_2O_3$ concentration of between about 0.09 percent and about 0.1 percent (i.e., less than about 0.1 percent) by weight of the zirconium concentrated product.

The composition of the zirconium concentrated product produced in the pilot plant testing of the exemplary embodiment may therefore be considered as a "premium grade" zirconium product.

As previously mentioned, in some embodiments, the method of the invention may emphasize scavenging over cleaning, due at least in part to the relatively fine particle size of the zirconium which may be contained in the head feed material (such as heavy mineral concentrate (12)). Scavenging is attractive for recovering minerals having a relatively fine particle size, because minerals having a relatively fine particle size are typically more difficult to recover efficiently than minerals having a relatively coarse particle size, and methods which emphasize cleaning over scavenging often experience reduced recoveries as the particle size of the desired product becomes smaller.

One strategy of the method of the invention is therefore to "carry" a higher mass of tailings through the circuits than is typical for the recovery of minerals having a relatively coarse particle size, in order to provide opportunities to recover the heavy minerals from the feed materials.

A second strategy of the method of the invention is to provide a plurality of scavenger stages in many of the circuits, since each scavenging stage represents an opportunity to recover additional zirconium. In general, additional scavenging stages in any of the circuits will improve the zirconium recovery.

A third strategy of the method of the invention is generally to provide a relatively wide particle size distribution in the feed materials which are presented to the circuits. The reason for this is that the inventors have discovered that the recovery performance of minerals having a relatively fine particle size may be improved by providing a relatively wide particle size distribution, in comparison with processing only particles having a relatively fine particle size.

For example, referring to FIG. 10, it can be seen that the heavy mineral concentrate (12) has a particle size distribution in which about 40 percent of the particles have a particle size of between about 44 microns and about 100 microns, about 3 percent of the particles have a particle size smaller than about 44 microns, and about 57 percent have a particle size between about 100 microns and about 350 microns.

Without being bound by theory, it is believed that the presence of relatively coarse particles in the feed materials may reduce material handling issues associated with relatively fine particles, such as dusting and entrainment away from active surfaces by adhesion to equipment, while simultaneously providing improved surface area coverage on active surfaces for processing of the relatively fine particles.

More particularly, it is believed that with relatively fine particles, which can become dusty, there may be some entrainment away from actives surfaces (i.e., by being projected from the surfaces of rotating equipment such as electrostatic and magnetic rolls or of reciprocating equipment such as shaker tables). It is believed that relatively coarse particles can: (1) provide some momentum to assist in the transport of relatively fine particles in the desired direction; and (2) provide an ability to obtain a relatively better packing of particles at active surfaces (i.e., the difference between packing uniform spheres and packing a distribution of sphere sizes).

This is achieved in the method of the invention by minimizing the number of sizing operations which are performed on the feed materials in the performance of the method, and by delaying such sizing operations. In the exemplary embodiment, a single sizing operation is conducted between the finishing electrostatic separation (50) and the finishing magnetic separation (52), to remove particles having a particle size greater than about 100 microns. The purpose of this sizing operation in the exemplary embodiment is to assist in "polishing" in the finishing dry separation, by removing material having a particle size greater than about 100 microns, since such particles are typically not associated with heavy minerals such as zirconium in froth treatment tailings.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. A method for processing a heavy mineral concentrate obtained from froth treatment tailings to produce a zirconium concentrated product, wherein the froth treatment tailings result from a process for recovering bitumen from oil sand, wherein the process for recovering bitumen from oil sand is comprised of producing a bitumen froth from the oil sand, wherein the process for recovering bitumen from oil sand is further comprised of separating the froth treatment tailings from the bitumen froth in a froth treatment process, the method comprising:

(a) subjecting the heavy mineral concentrate to froth flotation to selectively recover zirconium in order to produce a flotation product;

(b) subjecting the flotation product to initial gravity separation to selectively recover zirconium in order to produce an initial gravity separation product;

(c) subjecting the initial gravity separation product to primary electrostatic separation to selectively recover zirconium in order to produce a primary electrostatic separation product;

(d) subjecting the primary electrostatic separation product to primary magnetic separation to selectively recover zirconium in order to produce a primary magnetic separation product;

(e) subjecting the primary magnetic separation product to finishing gravity separation to selectively recover zirconium in order to produce a finishing gravity separation product;

(f) subjecting the finishing gravity separation product to finishing electrostatic separation to selectively recover zirconium in order to produce a finishing electrostatic separation product; and (g) subjecting the finishing electrostatic separation product to finishing magnetic separation to selectively recover zirconium in order to produce a finishing magnetic separation product as the zirconium concentrated product.

2. The method as claimed in claim 1 wherein the froth flotation is comprised of a froth flotation circuit comprising a plurality of froth flotation stages.

3. The method as claimed in claim 2 wherein the froth flotation circuit is comprised of at least two froth flotation stages arranged in a configuration which comprises a rougher stage and at least one scavenger stage.

4. The method as claimed in claim 3 wherein the rougher stage of the froth flotation circuit is performed using a plurality of rougher cells, and wherein each of the scavenger stages of the froth flotation circuit is performed using a plurality of scavenger cells.

5. The method as claimed in claim 4 wherein the froth flotation circuit is comprised of two froth flotation stages.

6. The method as claimed in claim 5 wherein the rougher stage of the froth flotation circuit is performed using five rougher cells, and wherein the scavenger stage of the froth flotation circuit is performed using four scavenger cells.

7. The method as claimed in claim 1 wherein the initial gravity separation is comprised of an initial gravity separation circuit comprising a plurality of initial gravity separation stages.

8. The method as claimed in claim 7 wherein the initial gravity separation circuit is comprised of at least four initial gravity separation stages arranged in a configuration which comprises a rougher stage, at least one cleaner stage, and a plurality of scavenger stages.

9. The method as claimed in claim 8 wherein each of the initial gravity separation stages is performed using a spiral separator.

10. The method as claimed in claim 9 wherein the initial gravity separation circuit is comprised of seven initial gravity separation stages.

11. The method as claimed in claim 1 wherein the primary electrostatic separation is comprised of a primary electrostatic separation circuit comprising a plurality of primary electrostatic separation stages.

12. The method as claimed in claim 11 wherein the primary electrostatic separation circuit is comprised of at least four primary electrostatic separation stages arranged in a configuration which comprises a rougher stage, at least one cleaner stage, and a plurality of scavenger stages.

13. The method as claimed in claim 12 wherein each of the primary electrostatic separation stages is performed using a high tension roll separator.

14. The method as claimed in claim 13 wherein the primary electrostatic separation circuit is comprised of five primary electrostatic separation stages.

15. The method as claimed in claim 1 wherein the primary magnetic separation is comprised of a primary magnetic separation circuit comprising a plurality of primary magnetic separation stages.

16. The method as claimed in claim 15 wherein the primary magnetic separation circuit is comprised of at least two primary magnetic separation stages arranged in a configuration which comprises a rougher stage and at least one scavenger stage.

17. The method as claimed in claim 16 wherein each of the primary magnetic separation stages is performed using a rare earth magnet roll separator.

18. The method as claimed in claim 17 wherein the rare earth magnet roll separator used in the rougher stage of the primary magnetic separation circuit is comprised of three rare earth magnet rolls.

19. The method as claimed in claim 17 wherein the rare earth magnet roll separator used in each of the scavenger stages of the primary magnetic separation circuit is comprised of three rare earth magnet rolls.

20. The method as claimed in claim 17 wherein the primary magnetic separation circuit is comprised of two primary magnetic separation stages.

21. The method as claimed in claim 1 wherein the finishing gravity separation is comprised of a finishing gravity separation circuit comprising a plurality of finishing gravity separation stages.

22. The method as claimed in claim 21 wherein the finishing gravity separation circuit is comprised of at least four finishing gravity separation stages arranged in a configuration which comprises a rougher stage, at least one cleaner stage, and a plurality of scavenger stages.

23. The method as claimed in claim 22 wherein each of the finishing gravity separation stages is performed using a shaker table separator.

24. The method as claimed in claim 23 wherein the finishing gravity separation circuit is comprised of four finishing gravity separation stages.

25. The method as claimed in claim 1 wherein the finishing electrostatic separation is comprised of a finishing electrostatic separation circuit comprising a plurality of finishing electrostatic separation stages.

26. The method as claimed in claim 25 wherein the finishing electrostatic separation circuit is comprised of at least four finishing electrostatic separation stages arranged in a configuration which comprises a rougher stage, at least one cleaner stage, and a plurality of scavenger stages.

27. The method as claimed in claim 26 wherein each of the finishing electrostatic separation stages is performed using a high tension roll separator.

28. The method as claimed in claim 27 wherein the finishing electrostatic separation circuit is comprised of four finishing electrostatic separation stages.

29. The method as claimed in claim 1 wherein the finishing magnetic separation is comprised of a finishing magnetic separation circuit comprising a plurality of finishing magnetic separation stages.

30. The method as claimed in claim 29 wherein the finishing magnetic separation circuit is comprised of at least three finishing magnetic separation stages arranged in a configuration which comprises a rougher stage, at least one cleaner stage and at least one scavenger stage.

31. The method as claimed in claim 30 wherein each of the finishing magnetic separation stages is performed using an induced magnet roll separator.

32. The method as claimed in claim 31 wherein the finishing magnetic separation circuit is comprised of four finishing magnetic separation stages.

33. The method as claimed in claim 1, further comprising removing an oversize fraction from the finishing electrostatic separation product before subjecting the finishing electrostatic separation product to the finishing magnetic separation.

34. The method as claimed in claim 33 wherein the oversize fraction has a particle size greater than about 100 microns.

* * * * *